United States Patent [19]

Mizukami

[11] Patent Number: 4,699,861

[45] Date of Patent: Oct. 13, 1987

[54] PHOTOSENSITIVE MEMBER FOR USE IN ELECTROPHOTOGRAPHY

[75] Inventor: Hiroyuki Mizukami, Hiratsuka, Japan

[73] Assignee: Kabushiki Kaisha Komatsu Seisakusho, Tokyo, Japan

[21] Appl. No.: 942,350

[22] Filed: Dec. 16, 1986

[30] Foreign Application Priority Data

Dec. 20, 1985 [JP] Japan ..... 60-287437

[51] Int. Cl.[4] ..... G03G 5/082

[52] U.S. Cl. ..... 430/64; 430/67

[58] Field of Search ..... 430/63, 64, 65, 66, 430/67

[56] References Cited

U.S. PATENT DOCUMENTS 4,532,150 7/1985 Endo et al. ..... 430/64

4,544,617 10/1985 Mort et al. ..... 430/67

FOREIGN PATENT DOCUMENTS 839557 5/1985 Japan .

112048 6/1985 Japan .

*Primary Examiner*—J. David Welsh

*Attorney, Agent, or Firm*—Welsh & Katz, Ltd.

[57] ABSTRACT

The photosensitive member is constituted by a supporting member made of pure aluminum coated with a porous amorphous aluminum oxide anhydride layer, a photoconductive layer formed on the supporting member and comprises a hydrogenated amorphous silicon layer, an intermediate layer laminated on the photoconductive layer and consists of amorphous silicon nitride or amorphous silicon carbide and a surface layer laminated on the intermediate layerand consists of hydrogen containing amorphous boron nitride.

15 Claims, 8 Drawing Figures

| surface layer | a-SiC+a-BN | a-BN | a-SiN+a-BN |
|---|---|---|---|
| layer thickness | ~1500 Å | ~1500 Å | a-SiN ~200 Å<br>a-BN ~100 Å |
| surface potential | 550 v | 740 v | 680 v |
| photo-sensitivity $400_v - 200_v$ | 1.0 lux·s | 0.8 lux·s | 0.8 lux·s |
| picture image characteristics |  |  |  |

PHOTOSENSITIVE MEMBER FOR USE IN ELECTROPHOTOGRAPHY

BACKGROUND OF THE INVENTION

1. Field of the Invention

This invention relates to a photoconductive member for use in electrophotography, and more particularly to a novel construction of the photoconductive member for use in electrophotography capable of preventing flow and blur of images.

2. Description of the Prior Art

In recent years, as a substitute for inorganic photoconductive materials (hereinafter photoconductive material is often called photoconductor) such as Se, Cds and ZnO, or organic photoconductive material such as poli-n-vynil carbozol and trinitrofluorenone, amorphous silicon photosensitive member using hydrogenated amorphous silicon layer as a photoconductor have become noted for use in electrophotography because of their excellent heat resistance property, wear resistant property, harmless property and high photosensitivity.

As the amorphous silicon type photoconductor for use in electrophotography, a photoconductor comprising an aluminum supporting member and an amorphous silicon layer formed thereon to act as a photoconductive layer has been widely used. However, since the adhesive force of the amorphous silicon to aluminum is not sufficiently large, we have succeeded to improve the adhesive property by subjecting the surface of an aluminum layer 11 to an almite treatment (oxidation treatment) to form a porous layer 12B formed of an anhydrous amorphous aluminum layer whose surface containing numerous fine pores and then applying a hydrogenated amorphous layer 13 to the porous layer **12*b* without sealing the fine pores as shown in FIG. 6**.

Then an amorphous boron layer 14 (a-BN) is applied to the upper surface of the hydrogenated amorphous silicon layer. The amorphous boron nitride layer 14 has properties of an excellent insulating strength and a small light absorption, and can prevent light reflection and is not influenced by environment condition variation.

In the art of electrophotography, the recording of images is made in the following manner. More particularly, after applying uniform electric charge onto the surface of a photoconductor by using corona discharge, a light image is projected. Due to the absorption of the projected light, electron-hole pairs are formed in the photoconductive layer and the electrons and holes thus formed are caused to migrate due to the surface charge so as to cause to remain the surface charge only at regions not irradiated or exposed to light (formation of a latent image). When an oppositely charged toner is sprinkled onto the latent image thus formed, the remaining surface charge attracts the toner through the photoconductor layer and the insulative amorphous boron nitride layer, thus developing or visualizing the latent image. Then the developed toner image is transfer printed onto a copying paper. At this time, there is a tendency of flow or blur of the image, thus failing to obtain a clear copy.

Although it is considered that this is caused by the decrease of the electrostatic attractive force due to the presence of the photoconductive layer and the surface layer, this cause has been considered impossible to eliminate.

SUMMARY OF THE INVENTION

It is therefore an object of this invention to obtain a novel photosensitive member for use in electrophotography capable of obtaining clear copy or record free from flow or blur of the image.

According to this invention, there is provided a photosensitive member for use in electrophotography of the type wherein the surface of a supporting member is coated with a porous amorphous aluminum oxide anhydride, a hydrogenated amorphous silicon layer acting as a photoconductive layer, and a hydrogen containing amorphous boron nitride layer acting as a surface layer, characterized by an intermediate layer interposed between the photoconductive layer and the surface layer, the intermediate layer consisting of amorphous silicon nitride (a-SiN) or amorphous silicon carbide (a-SiC).

Figure 1:
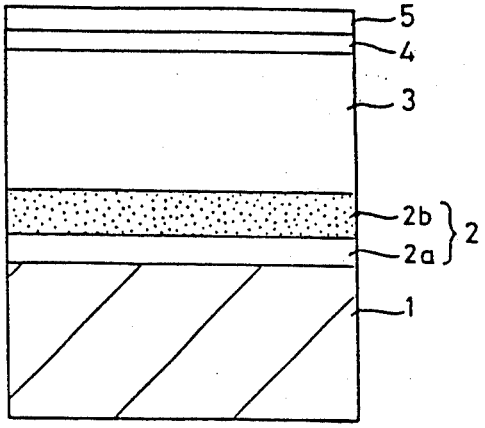
FIG. 1 is a sectional view showing one embodiment of the photosensitive member according to this invention.
Figure 3:
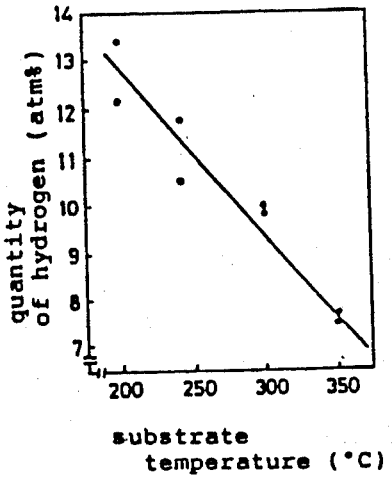
Figure 4:
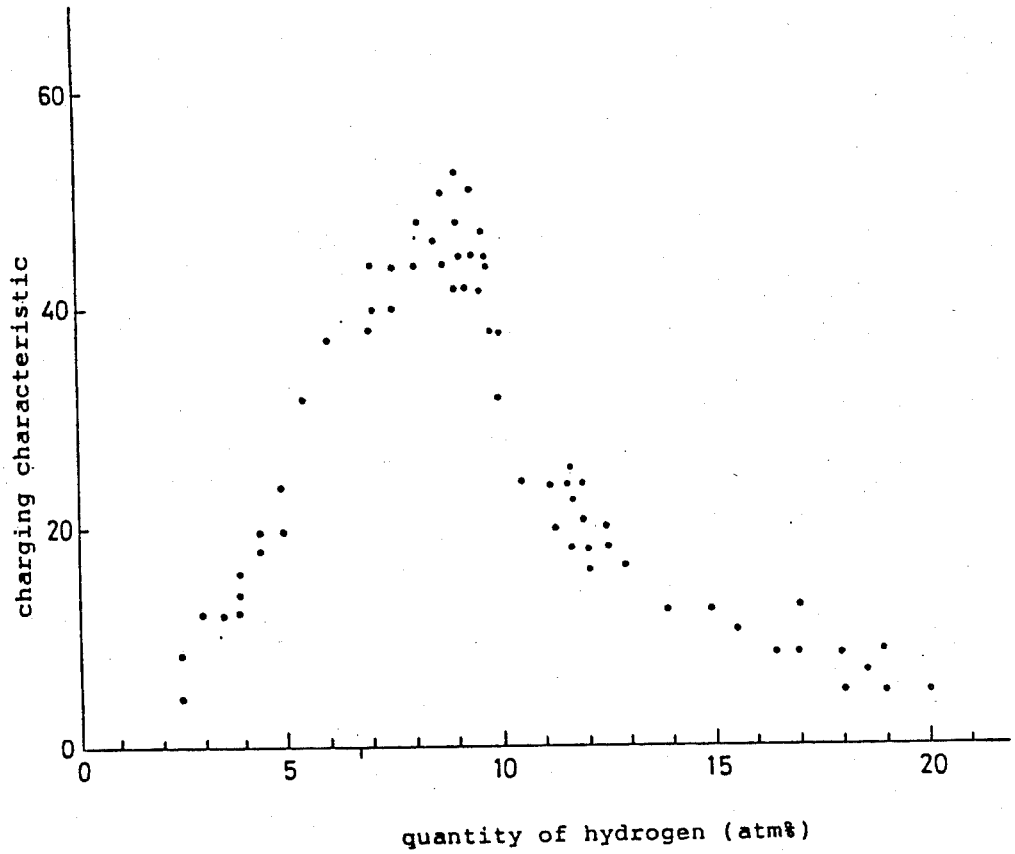
Figure 5:
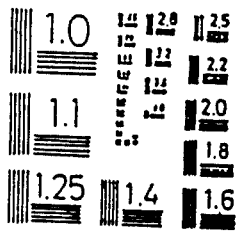
Figure 5:
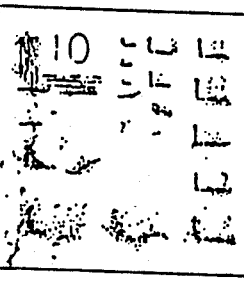
Figure 5:
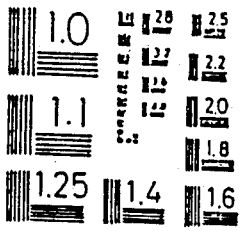
Figure 6:
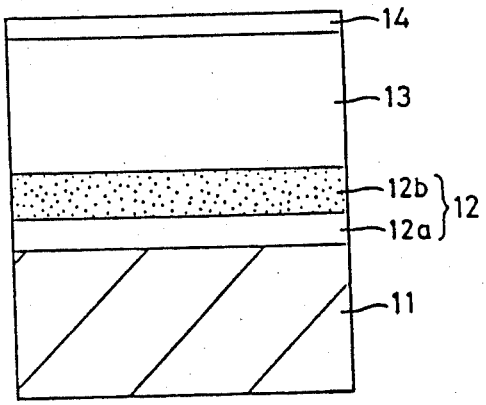
FIG 6 PRIOR ART

FIGS. **2*a*, 2*b* and 2*c* are sectional views showing succesive steps of manufacturing the photosensitive member shown in FIG. 1**;

FIG. 3 is a graph showing the relation between the substrate temperature and the water content in the photoconductive layer at the time of preparing the same;

FIG. 4 is a plot showing the relation between the quantity of hydrogen in the photoconductive layer and the charging capability;

FIG. 5 is a table showing comparison data of the surface potential, photosensitivity, picture image characteristics of the photosensitive members of this invention and of the prior art; and FIG. 6 is a sectional view showing the photosensitive member of the prior art.

DESCRIPTION OF THE PREFERRED EMBODIMENT

As shown in FIG. 1, the photosensitive member of this invention for use in electrophotography comprises a lamination of a cylindrical or sheet shaped aluminum 1 having a purity of higher than 99.5% and is formed on its surface with an almite layer not containing any chemically combined water, a hydrolized amorphous silicon layer 3 (a-Si :H) having a thickness of 20 microns, containing hydrogen in 9.3 atm % and formed on the surface of the almite layer to act as a photoconductive layer, and an amorphous silicon nitride layer $(a\text{-}SiN)_4$ having a thickness of 100 Å and acting as an intermediate layer and a hydrogen containing amorphous boron nitride layer 5 (a-BN) acting as a surface layer.

The almite layer is of the double layer construction consisting of a dense barrier layer made of aluminum oxide of a thickness of 100A and a porous layer having a thickness of 1 micron and made of anhydride amorphous aluminum oxide containing numerous micropores.

A method of manufacturing the photosensitive member will now be described.

At first, an electrolytic treatment is performed using as an anode pure aluminum formed into a cylinder, a sheet or other suitable configuration and electrolyte such as sulfuric acid and oxalic acid so as to form an almite layer 2 consisting of a barrier layer **2*a* having a thickness of 100 Å and a porous layer 2*b*** having a thickness of 1 micron. The electrolysis voltage was 10–20 V, the electrolysis time of 2–30 minutes, the temperature of the electrolyte was 10°–25° C., the concentration was 10–20% and the current density was 1–2 A/dm$^2$.

Figure 2A:
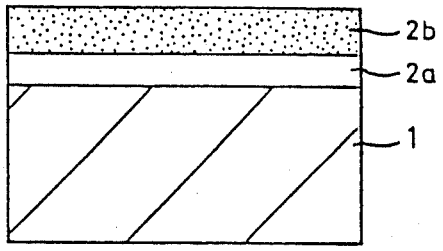
Figure 2B:
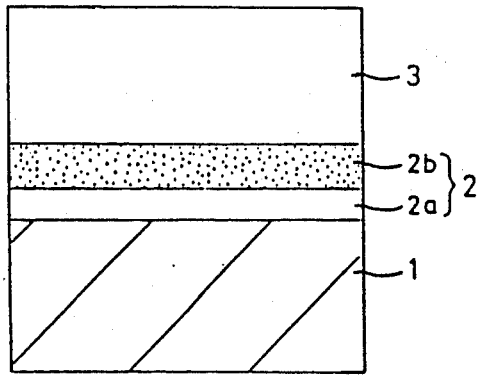

Then as shown in FIG. 2*b*, without sealing the micropores of the almite layer 2, a boron doped hydrogenated amorphous silicon layer 3 having a thickness of 20 micron and containing hydrogen in an amount of 9.3 atm % is coated on the surface of the porous layer 2 by plasma CVD method, thereby forming a photoconductive layer. The layer forming conditions were as follows: substrate (supporting member) temperature: 325° C.; reaction gas: a mixture of silan ($SiH_4$) and diboran ($B_2H_6$); gas pressure 1.0 Torr; quantity of gas flow: $SiH_4$ 100 SCCM, $B_2H_6$ 50 SCCM; applied frequency: 13.56 MHz; and power: 100 W. The hydrogen content of a layer thus formed varies depending upon the substrate temperature. the relation between the substrate temperature and the hydrogen content is shown in FIG. 3.

Figure 2C:
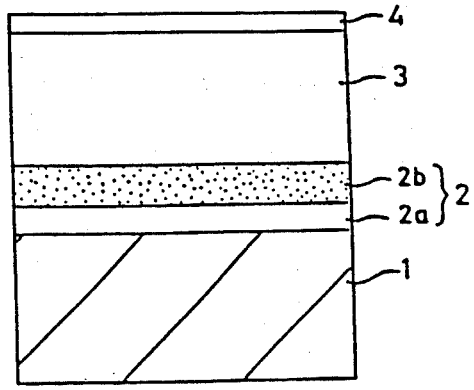

In the same manner, an amorphous silicon nitride layer 4 having a thickness of 100 Å and acting as an intermediate layer 4 is coated on the layer 3 by plasma CVD method. The layer forming conditions were: substrate temperature: 325° C.; reaction gas: a mixture of silane ($SiH_4$) and ammonium ($NH_3$); gas pressure 1.0 Torr; quantity of gas flow: $SiH_4$ 50 SCCM, $NH_3$ 50 SCCM; applied frequency: 13.56 MHz; and power: 100 W (FIG. 2*c*).

Further, a hydrogen containing amorphous boron nitride layer having a thickness of 1500 Å and acting as a surface layer was coated with (CVD method). The layer forming conditions were: substrate temperature: 325° C., reaction gas: a mixture of diborane ($B_2H_6$) and ammonium ($NH_3$); gas pressure: 1.0 Torr; quantity of gas flow $B_2H_6$ 100 SCCM, $NH_3$ 50 SCCM; applied frequency: 13.56 $MH_3$, and power: 100 W.

The hydrogenated amorphous silicon layer 3, the amorphous silicon nitride layer 4, and the amorphous boron nitride layer 5 can be consecutively formed by switching the reaction gases.

When forming a layer, the supporting member is set in the reaction chamber of a plasma CVD apparatus and then the reaction chamber is evacuated to a vacuum of about $10^{-6}$ Torr.

After stabilizing the temperature of the support to 325° C., the gas mixture is admitted into the reaction chamber while adjusting the flow quantity with a mass flow controller and then the pressure in the reaction chamber is set to 1.0 Torr with a gas pressure controller.

Under these conditions, the supporting member is grounded and a layer is formed by applying a high frequency power while matching the impedance with an impedance box.

When a desired layer thickness is reached, application of the high frequency power and the admission of the reaction gas are stopped.

By repeating the above described operation, the three layers are sequentially formed.

Finally, after evacuating the reaction chamber, the heating of the supporting member is stopped, and after breaking the vacuum, the supporting member is taken out from the reaction chamber.

In the photosensitive member described above, as the thickness alone of the amorphous silicon nitride layer acting as the intermediate layer is varied. The relation between the layer thickness and the picture image characteristics is shown in the following Table I in which symbol "◎" designates very excellent, "○" good, "Δ" normal and "x" bad. This table shows that the thickness of the amorphous silicon nitride layer should be less than 2000 Å.

TABLE I

| Layer thickness (Å) | 0 | 25 | 50 | 100 | 200 | 500 | 1000 | 2000 | 5000 |
|---|---|---|---|---|---|---|---|---|---|
| Picture image characteristic | Δ | Δ | ○ | ◎ | ◎ | ◎ | ○ | Δ | X |

Where the amorphous boron nitride layer and the amorphous silicon nitride layer are respectively used as the surface layer and the intermediate layer the surface, the comparison data of the potential, photosensitivity, and the picture image characteristics are shown in FIG. 5 where only the amorphous silicon nitride layer is used as the surface layer and where only the amorphous boron nitride layer is used as the surface layer.

As can be clearly noted from FIG. 5, the surface potential, photosensitivity and picture image characteristics are excellent where amorphous silicon nitride is used as the intermediate layer, and amorphous boron nitride is used as the intermediate layer.

In contrast, where only the amorphous silicon nitride layer is used, the surface potential and the photosensitivity are not sufficiently high, whereas where only the amorphous boron nitride is used, the picture image tends to blur.

The picture image characteristic in case the nitrogen content of the amorphous silicon nitride is varied is shown in the following Table II.

TABLE II

| Quantity of N (at %) | 0 | 1 | 5 | 10 | 20 | 30 | 40 | 50 |
|---|---|---|---|---|---|---|---|---|
| Picture image characteristic | Δ | ○ | ◎ | ◎ | ◎ | ○ | Δ | X |

From this table, it can be clearly noted that it is advantageous that the quantity of nitrogen content should be less than 40 atm %.

The photosensitive member prepared in the manner described above can prevent flow and blur of the image by the use of an intermediate layer, thereby providing a clear copy.

Moreover, the photoconductive layer and the supporting member can be strongly bonded together, and the photoelectric property is excellent.

Although the thickness of the barrier layer 2*a* and the porous layer 2*b* of the almite layer can be varied by varying the reaction conditions at the anode oxidation step, the relation between the adhesive power and the photoelectric characteristic of the thickness $\alpha$ of the barrier layer 2*a*, and the thickness $\beta$ of the porous layer 2*b* (photoconductive layer) is shown in Table III, in which symbol "○" means excellent, "x" inferior and "Δ" practically employable although not so excellent.

TABLE III

| Barrier layer α (A) Porous layer β(μm) | 10 | 100 | 200 | 500 | 1000 | |
|---|---|---|---|---|---|---|
| 0 | X | X | X | X | X | Adhesive force |
| | O | O | O | Δ | X | Photoelectric characteristic |
| 3 | O | O | O | O | O | Adhesive force |
| | O | O | O | Δ | X | Photoelectric characteristic |
| 5 | O | O | O | O | O | Adhesive force |
| | Δ | Δ | Δ | X | X | Photoelectric characteristic |
| 7 | O | O | O | O | O | Adhesive force |
| | X | X | X | X | X | Photoelectric characteristic |

This table shows that the adhesive force is increased as the thickness of the porous layer increases and that it is advantageous to limit the thickness of the porous layer to at most 5 microns when one considered the photoelectric characteristic. Although a thin barrier layer is preferred, the photoelectric characteristic will not be affected so long as the thickness lies in a range of 10 Å–500 Å.

At the time of forming the photoconductive layer, a photosensitive member was prepared by varying the quantity of hydrogen (atm %) in the hydrogenated amorphous silicon layer by changing the composition of the reaction gas, and the relation between the quantity of hydrogen and the charging performance (V/μ) was measured. The result of measurement is shown in FIG. 4 in which the ordinate shows the charging characteristic and the abscissa shows the hydrogen quantity. FIG. 4 clearly shows that especially excellent results can be obtained when the hydrogen content is maintained to be less than 20 atm %, especially in a range of 5–13 atm %.

As above described, a photosensitive member comprising a pure aluminum cylinder or sheet formed on its surface with an almite layer not comprising crystalline water, a hydrolized amorphous silicon layer acting as a photoconductive layer, an amorphous silicon nitride layer acting as an intermediate layer and an amorphous boron nitride layer acting as a surface layer, which are laminated sequentially, is free from flow of the image and has excellent properties in the adhesive force and the photoelectric characteristics.

Although in this embodiment, an amorphous silicon nitride layer was used as the intermediate layer, this layer can be substituted by an amorphous silicon carbide layer.

Further, the thickness $\alpha$ of the barrier layer of the almite layer on the surface of the supporting member was made to be 100 Å, and the thickness $\beta$ of the porous layer was made to be 6 micron. The barrier layer may be omitted. When it is made as thinner as possible, the photoelectric electric characteristic can be improved. However, the barrier layer is inevitably formed at the time of the almite forming treatment so that it is preferable to select the treatment conditions so as to determine $\alpha$ and in the ranges of 10 Å$\leqq\alpha\leqq$500 Å and $0\leqq\beta\leqq5$ μm.

The hydrogen content $C_H$ of the photoconductive layer is selected to be $C_H\leqq20$ atm %, more preferably 5 atm % $C_H$ 13 atm %, still more preferably 7 atm % $\leqq C_H\leqq10$ atm %.

The thickness of the photoconductive layer is selected in a range of $5\mu\leqq t\leqq80\mu$. With less than 5 microns a desired surface level could not be obtained whereas with higher than 80 microns the photoelectric characteristic would decrease. The quantity of boron doped in the photoconductive layer is selected in a range of $10^{-7}$ atm %$-10^{-5}$ atm %. Because with higher than $10^{-5}$ atm % of boron, a desired surface potential can not be obtained and since the amorphous silicon is a n type semiconductor in a not doped state, with less than $10^{-7}$ atm %, the resistance becomes low, thus failing to obtain a desired surface potential.

It is advantageous to make 1:1, the composition ratio of boron and nitrogen in the amorphous boron nitride comprising the surface layer. More particularly when setting $B_x$ and $N_{1-x}$, x is selected to be in a range of $0.2\leqq x\leqq0.8$. With regard to the layer thickness d, it is desirable to select it in a range of $0.01\mu\leqq d$ 10μ, preferably $0.05\mu\leqq d\leqq5\mu$. If the surface layer were too thin, blocking affect could not be expected whereas if it were too thick the photoelectric effect would degrade.

What is claimed is:

1. A photosensitive member for use in electrophotography of the type wherein the surface of a supporting member is coated with a porous anhydrous amorphous aluminum oxide, a hydrogenated amorphous silicon layer acting as a photoconductive layer, and a hydrogen containing amorphous boron nitride layer acting as a surface layer, characterized by an intermediate layer interposed between said photoconductive layer and said surface layer, said intermediate layer consisting of amorphous silicon nitride (a-SiN) or amorphous silicon carbide (a-SiC).

2. The photosensitive member according to claim 1 wherein thickness of said intermediate layer is less than 2000 Å.

3. The photosensitive member according to claim 1 wherein said intermediate layer consists of an amorphous silicon nitride layer containing less than 40 atm % of nitrogen.

4. The photosensitive member according to claim 1 wherein said hydrogenated amorphous silicon layer contains hydrogen of less than 20 atm %.

5. The photosensitive member according to claim 4 wherein said hydrogenated amorphous silicon layer contains hydrogen in a range of 5–13 atm %.

6. The photosensitive of member according to claim 1 wherein said hydrogenated amorphous silicon layer contains hydrogen in a range of 7–10 atm %.

7. The photosensitive member according to claim 1 wherein said hydrogenated amorphous silicon layer has a thickness in a range of 5 to 80 microns.

8. The photosensitive member according to claim 1 wherein said hydrogenated amorphous silicon layer comprises a hydrogenated amorphous silicon layer doped with boron in an amount of $10^{-7}$–$10^{-5}$ atm %.

9. The photosensitive member according to claim 1 wherein said hydrogenated amorphous silicon layer has a thickness of 5–80 microns.

10. The photosensitive member according to claim 1 wherein said amorphous boron nitride layer is composed of $B_x N_{1-x}$ where $0.2\leqq x\leqq0.8$.

11. The photosensitive member according to claim 1 wherein said amorphous boron nitride layer has a thickness of 0.01–10 microns.

12. The photosensitive element according to claim 11 wherein said amorphous boron nitride has a thickness of 0.05–5 microns.

13. The photosensitive member according to claim 1 further comprising a barrier layer consisting of a dense aluminum oxide layer interposed between said pure aluminum layer and said porous layer of said supporting member.

14. The photosensitive member according to claim 1 wherein said porous amorphous aluminum oxide anhydride has a thickness of less than 5 microns.

15. The photosensitive member according to claim 13 wherein said barrier layer has a thickness of 10–500 Å.

* * * * *

UNITED STATES PATENT AND TRADEMARK OFFICE

CERTIFICATE OF CORRECTION

PATENT NO. : 4,699,861

DATED : October 13, 1987

INVENTOR(S) : Mizukami, et al.

It is certified that error appears in the above-identified patent and that said Letters Patent is hereby corrected as shown below:

Line 9 of the Abstract, "layerand" should be --layer and--.

Column 1, Line 20, "have" should be --has--.

Column 1, Line 21, "their" should be --its--.

Column 1, Line 30, "succeeded" should be --proceeded--.

Column 2, Line 25, "succesive" should be --successive--.

Column 3, Line 8, "micron" should be --microns--.

Column 3, Line 14, "pressure" should be --pressure:--.

Column 3, Line 18, "the" should be --The--.

Column 3, Line 26, "ammonium" should be --ammonia--.

Column 3, Line 58, "are" should be --is--.

Column 5, Line 11 and Line 13, the symbols "o" should be realigned in the succeeding rows, respectively.

Column 5, Line 55, "micron" should be --microns--.

UNITED STATES PATENT AND TRADEMARK OFFICE

CERTIFICATE OF CORRECTION

PATENT NO. : 4,699,861

DATED : October 13, 1987

INVENTOR(S) : Mizukami, et al.

It is certified that error appears in the above-identified patent and that said Letters Patent is hereby corrected as shown below:

Column 5, Line 56, "thinner" should be --thin--.

Column 6, Line 46, "of" should be omitted.

Signed and Sealed this

Eighth Day of November, 1988

*Attest:*

*Attesting Officer*

DONALD J. QUIGG

*Commissioner of Patents and Trademarks*